US009003614B2

(12) United States Patent
Ozawa et al.

(10) Patent No.: US 9,003,614 B2
(45) Date of Patent: Apr. 14, 2015

(54) SLIDER FOR SLIDE FASTENER

(75) Inventors: Takanori Ozawa, Toyama (JP); Keiichi Keyaki, Toyama (JP); Ryuta Kumano, Toyama (JP)

(73) Assignee: YKK Corporation (JP)

( * ) Notice: Subject to any disclaimer, the term of this patent is extended or adjusted under 35 U.S.C. 154(b) by 238 days.

(21) Appl. No.: 13/638,941

(22) PCT Filed: Apr. 2, 2010

(86) PCT No.: PCT/JP2010/056071

§ 371 (c)(1),
(2), (4) Date: Oct. 2, 2012

(87) PCT Pub. No.: WO2011/125152

PCT Pub. Date: Oct. 13, 2011

(65) Prior Publication Data

US 2013/0025092 A1 Jan. 31, 2013

(51) Int. Cl.
*A44B 19/30* (2006.01)
*A44B 19/26* (2006.01)

(52) U.S. Cl.
CPC ..... *A44B 19/26* (2013.01)

(58) Field of Classification Search
CPC .... A44B 19/26; A44B 19/262; A44B 19/306; A44B 19/24
USPC ..... 24/415, 429, 430
See application file for complete search history.

(56) References Cited

U.S. PATENT DOCUMENTS

| | | | | |
|---|---|---|---|---|
| 3,793,684 | A | 2/1974 | Moertel | |
| 4,980,954 | A | 1/1991 | Takabatake et al. | |
| 5,621,954 | A | 4/1997 | Mizuno | |
| 7,089,632 | B2 * | 8/2006 | Keyaki et al. | 24/429 |
| 7,624,481 | B2 * | 12/2009 | Iwase et al. | 24/421 |
| 8,356,391 | B2 * | 1/2013 | Iwase | 24/421 |
| 2004/0231114 | A1 * | 11/2004 | Iwase et al. | 24/424 |
| 2004/0231115 | A1 | 11/2004 | Keyaki et al. | |

FOREIGN PATENT DOCUMENTS

| | | |
|---|---|---|
| JP | 60-70308 | 5/1985 |
| JP | 2004-344310 A | 12/2004 |

OTHER PUBLICATIONS

International Search Report, PCT Application No. PCT/JP2010/056071, mailed Jul. 6, 2010.

* cited by examiner

*Primary Examiner* — Robert J Sandy
*Assistant Examiner* — Michael Lee
(74) *Attorney, Agent, or Firm* — Kilpatrick Townsend & Stockton LLP

(57) ABSTRACT

Engaged portions formed on a tab holder are elastically engaged and attached to engaging portions formed on a first column portion and the rear side of a second column portion on an upper blade, and a pair of protrusions formed on the inner side of the tab holder are fitted in a recession formed on an inclined surface of the first column portion and a recession formed on an inclined surface of the second column portion. Further, stepped portions formed at both edge portions of both front and rear ends of the tab holder are brought in contact with end surfaces and inner sides of support walls installed at both edge portions of inclined surfaces. The slide fastener can improve attachment strength of the tab holder, implement excellent durability for a long period of time, excellent external appearance, and excellent assembly performance.

4 Claims, 14 Drawing Sheets

SLIDER FOR SLIDE FASTENER

This application is a national stage application of PCT/JP2010/056071 which is incorporated herein by reference.

TECHNICAL FIELD

The invention relates to a slider for a slide fastener having a slider body made by a resin material and a tab holder, and particularly, to a slider for a slide fastener that can improve attachment strength of a tab holder and achieve excellent durability over a long period of time and has an excellent external appearance and excellent assembly performance.

Further, in the invention, the top of the shoulder is positioned forward and the rear opening of the slider is positioned rearward when seen from above the slider. In addition, it is assumed that the width direction of the slider is the left-right direction and the installation direction of a diamond connecting upper and lower blades is an up-down direction.

BACKGROUND ART

In the related art, for example, mounting a slide fastener on an opening of clothes or bags and the like is generally used. The basic structure of a slider for a slide fastener is configured by three members of a slider body having upper and lower blades connected at the front ends with a predetermined gap by a diamond, a tab, and a tab holder that holds and allows the tab to move and rotate between the upper surface of the upper blade and the tab holder.

An example of such type of slider has been proposed by the applicant(s), as a slider for a slide fastener (see, for example, Patent Document 1). For the slider for a slide fastener described in Patent Document 1, as an example of the invention in the related art, FIG. 15 is a perspective view illustrating the state before assembling and FIG. 16 is a perspective view illustrating a modified example.

As illustrated in FIGS. 15 and 16, a tab holder 69 is fitted between a pair of column portions 61 and 62 installed at the front and rear portions on the upper surface of a slider body 60 in a snap type, by elastically deforming a cover body configured as the tab holder 69. A plane portion 73 is formed on the upper surfaces of the pair of column portions 61 and 62 and a sliding guide surface 74 that is smoothly inclined is formed from the end of the plane portion 73 to engaging portions 63 and 64 of the lower portion.

That is, as engaging portions 70 and 70 formed at both ends of the cover body slides along the sliding guide surface 74, the gap between the engaging portions 70 and 70 is increased, so that the engaging portions 70 and 70 are engaged with the engaging portions 63 and 64 formed at the column portions 61 and 62 and the tab holder 69 is fitted to the slider body 69. Further, a pintle 68 of a tab 67 may be held between the pair of column portions 61 and 62 and the tab holder 60.

In general, as the resin material of the cover body, relatively hard resin is used. Accordingly, even though the cover body is engaged and attached between the pair of column portions 61 and 62 by elastically deforming the cover body such that the gap between the engaging portions 70 and 70 formed at both ends of the cover body increases, and even though the cover body is returned in the direction in which the gap between the engaging portions 70 and 70 relatively decreases after engaging and attaching, the gap may not return to the previous gap before the elastic deformation.

In this state, slip is generated between the cover body and the pair of column portions 61 and 62, and when the tab 67 is operated, the cover body may be separated from the pair of column portions 61 and 62. In order to prevent that, in the slider for a slide fastener of Patent Document 1, as illustrated in FIG. 15, support walls 65 and 66 are installed at the sides of the column portions 61 and 62 to prevent slip in the left and right directions. Further, as illustrated in FIG. 16, protrusions 71 and 72 are formed on the upper surfaces of the column portions 61 and 62 and recessions where the protrusions 71 and 72 are fitted are formed on the inner side of the cover body which corresponds to the protrusions 71 and 72. In addition, a plane portion 75 is formed on the upper surfaces of the pair of column portions 61 and 62 and a sliding guide surface 76 that is smoothly inclined is formed from the end of the plane portion 75 to the lower engaging portions 63 and 64.

As described above, as the configuration where the support walls 65 and 66 are installed at the sides of the column portions 61 and 62 is employed, and as the configuration in which the protrusions 71 and 72 and the recessions are formed is employed, even if the gap between the engaging portions 70 and 70 is not returned to the previous gap before elastic deformation after the cover body is engaged and attached between the pair of column portions 61 and 62, slip between the cover body and the pair of column portions 61 and 62 can be prevented.

However, when the cover body is mounted on the pair of column portions 61 and 62, the engaging portions 70 and 70 of the cover body may come in contact with the plane portions 73 and 75 formed on the upper surfaces of the column portions 61 and 62, without coming in contact first with the sliding guide surfaces 74 and 76 formed at the column portions 61 and 62. In this case, even if the force pressing from above is fully applied to the cover body, the engaging portions 70 and 70 being in contact with the plane portions 73 and 75 cannot slide to the sliding guide surfaces 74 and 76. In particular, when this situation is generated during assembly work using an automatic assembly machine, when pressing force is forcibly applied to the cover body, the cover body may be broken.

However, when the slider body 60 or the cover body is made of a resin material, barrel polishing is generally performed on the formed product to remove burrs from the formed product. In this barrel polishing, a plurality of formed products are caused to hit each other and the formed products and an abrasive are caused to hit each other by putting the abrasive and the many formed products into a barrel and eccentrically rotating the barrel, thereby removing burrs sticking on the products in forming.

The thicknesses of the support walls 65 and 66 formed at the sides of the column portions 61 and 62 are small and edges of the support walls 65 and 66 individually protrude. Therefore, there is a problem in that a defect is generated in the support walls 65 and 66 by shock in barrel polishing, and particularly, a defect is generated at the edges or the portions around the edges are bleached. In particular, the smaller the size of the slider, the more the problem becomes remarkable.

In order to prevent a defect or beaching of the support walls 65 and 66 formed at the sides of the column portions 61 and 62 or the edges of the support walls 65 and 66, it is considered to increase the thicknesses of the support walls 65 and 66. However, in this case, the thicknesses of the support walls 65 and 66 are increased, but it is necessary to reduce the widths of the engaging portions 70 and 70 formed at the cover body.

That is, since the engaging portions 70 and 70 pass between the support walls 65 and 66 when the cover body is engaged and attached, when thicknesses of the support walls 65 and 66 are large, it is necessary to make the widths of the engaging portion 70 and 70 small. Therefore, in the engaging portions 70 and 70 of a cover body of which the width is small, a defect or bleaching of the engaging portions 70 and 70 is generated.

Further, as illustrated in FIG. 16, even in the case when the protrusions 71 and 72 are formed at the column portions 61 and 62, a defect or bleaching is generated in the protrusions 71 and 72. When a slider is manufactured by using a slider body 60 or a cover body where a defect or bleaching is generated, there is a problem in that attachment strength of the cover body is reduced. In addition, when the bleached portion is seen from the outside with naked eyes, there is a problem in terms of the external appearance.

In addition, when a resin product is bleached, the bleached portion is plastically deformed. Therefore, it is impossible to generate elastic deformation at the bleached portion, such that strength is correspondingly reduced. In addition, when tensile strength is applied to the bleached portion, the bleached portion is easily fully elongated.

PRIOR ART DOCUMENT

Patent Document

Patent Document 1: Japanese Patent Application Laid-Open No. 2004-344310

SUMMARY OF THE INVENTION

Problems to be Solved by the Invention

The invention has been made in an effort to improve the invention described in Patent Document 1 and provide a slider for a slide fastener that can solve the problems described above, improve attachment strength of a tab holder, achieve excellent durability for a long period of time, and has an excellent external appearance and excellent assembly performance.

Means for Solving the Problems

Objects of the invention can be achieved by the following basic configurations of the invention. That is, a slider for a slide fastener of the invention includes: a slider body having an upper blade and a lower blade that are spaced with a predetermined gap in the up-down direction and connected with each other by the front portions with a connecting post therebetween; a tab; and a tab holder that holds the tab between the upper surface of the upper blade and the tab holder to be movable and rotatable, in which in that at least the slider body and the tab holder are made of a resin material, a first column portion and a second column portion installed at the front and rear portions on the upper surface of the upper blade are included, engaging portions are formed on the front side of the first column portion and the rear side of the second column portion, respectively, the tab holder is configured by a plate-shaped cover body having an upper wall portion, and a front wall portion and a rear wall portion extending downward in the longitudinal direction of the upper wall portion, an engaged portion that is elastically engaged and attached to the engaging portion of the first column portion is formed on the rear inner side of the front wall portion, an engaged portion that is elastically engaged and attached to the engaging portion of the second column portion is formed on the front inner side of the rear wall portion, in the first column portion, an inclined surface inclined downward toward the front side from a rear side upper edge portion of the first column portion is formed at the center portion in the left-right width direction of the first column portion, support walls extending from the rear side upper edge portion of the first column portion are installed along both the left and right edge portions of the inclined surface of the first column portion, and a front edge portion on the front side of the inclined surface of the first column portion is disposed inside further than the front ends of the support walls of the first column portion, in the second column portion, an inclined surface inclined downward toward the rear side from a front side upper edge portion of the second column portion is formed at the center portion in the left-right width direction of the second column portion, support walls extending from the front side upper edge portion of the second column portion are installed along both the left and right edge portions of the inclined surface of the second column portion, and a front edge portion on the rear side of the inclined surface of the second column portion is disposed inside further than the rear ends of the support walls of the second column portion, recessions are formed on the inclined surfaces, respectively, of the first column portion and the second column portion, and when the tab holder is engaged and attached to the first column portion and the second column portion, protrusions that are fitted in the recessions respectively are formed on the inner side of the tab holder which faces the first column portion and the second column portion, and a stepped portion being in contact with the end surfaces of the support walls and the inner side of the support walls is formed along both edge portions of the tab holder, at both edges of the tab holder which face the support walls of the first column portion and the support walls of the second column portion.

Further, in the invention, the upper surfaces of the protrusions formed on the inner side of the tab holder are formed on inclined surfaces inclined upward at an angle toward the center portion in the longitudinal direction of the tab holder from an edge portion adjacent to the inner side of the tab holder at the side of the end of the tab holder in the longitudinal direction of the tab holder.

In addition, in the invention, open grooves are formed between at least one of recessions formed at the first column portion and the second column portion and the rear side of the first column portion or the front side of the second column portion to communicate them, protruding pieces that are fitted in the open grooves are formed on the inner side of the tab holder which face the open grooves, when the tab holder is engaged and attached to the first column portion and the second column portion, and the protruding pieces are integrally formed with the protrusions fitted in the recessions that communicate with the open grooves.

Furthermore, in the invention, the protrusions integrally formed with the protruding pieces and the protruding pieces are formed in T-shapes when seen from above.

Effect of the Invention

In the invention, the support walls installed along both the left and right edge portions of the inclined surfaces of the column portions are configured as support walls extending from the rear upper edge portion to the front side of the first column portion or from the front upper edge portion to the rear side of the second column portion. By this configuration, at the rear upper edge portion of the first column portion or the front upper edge portion of the second column portion, in the support walls, the edge protruding upward from the column portions is removed.

Further, even when barrel polishing is performed on the slider body, edges protruding upward from the column portions are not formed, so that the support walls of the slider body are not damaged or bleached in barrel polishing. In addition, the wall portion is formed between the inner sides of the recessions formed on the inclined surfaces and the rear side of the first column portion or the front side of the second column portion, and the wall portion can be configured as a wall portion having a desired thickness, so that it is possible to prevent the wall portion from being damaged or bleached, even if barrel polishing is performed on the slider body.

The front edge portion at the front side of the inclined surface of the first column portion is configured to be disposed inside further than the front end side of the support wall of the first column portion and the front edge portion at the rear side of the inclined surface of the second column portion is configured to be disposed inside further than the rear end side of the support wall of the second column portion. By this configuration, the engaging portion formed on the front side of the first column portion and the engaging portion formed on the rear side of the second column portion can be disposed inside further than the support walls. Further, even if barrel polishing is performed on the slider body, it is possible to prevent the engaging portions from being damaged or bleached.

Further, since the protrusions fitted in the recessions formed on the inclined surfaces are formed on the inner side of the tab holder, not a configuration protruding like an individual tower such as when a protrusion is formed at the column portion of the slider body, as a protrusion installed on the inner side of the tab holder, the height can be configured to be small. Therefore, when barrel polishing is performed on the tab holder, it is possible to prevent the protrusion formed on the inner side of the tab holder from being damaged or bleached. In addition, since it is possible to fit the protrusion formed on the inner side of the tab holder into the recession formed on the inclined surface, it is possible to prevent slipping in the front-rear and left-right directions between the tab holder and the slider body.

Further, stepped portions are formed along both edge portions at both sides of the tab holder and the stepped portions of the tab holder are configured to be in contact with the ends and the inner sides of the support walls of the column portions. By this configuration, when the tab holder is engaged and attached between the pair of column portions, it is possible to cover the support walls of the column portions with the tab holder from above without generating a gap between the support walls of the column portions and the tab holder. Accordingly, it is possible to achieve a configuration having good external appearance and excellent design. In addition, the state of engaging and attaching of the protrusions formed on the inner side of the tab holder and the recessions formed at the column portions is not seen from the outside with naked eyes, thereby improving the external appearance.

Since the stepped portions of the tab holder can be brought in contact with the ends and the inner sides of the support walls of the column portions, it is possible to prevent slipping in the front-rear and left-right directions between the tab holder and the slider body, with the stepped portions of the tab holder and the support walls of the column portions.

Further, the downward inclined surfaces are formed at the column portions from the rear upper edge portion of the first column portion and the front upper edge portion of the second column portion, and the inclined surfaces are configured to extend to the engaging portions. Therefore, when the tab holder is engaged and attached to the pair of column portions, the inclined surfaces can be used as guide surfaces and the tab holder can be smoothly engaged and attached, when the engaging portions of the tab holder are engaged and attached to the engaging portions.

In particular, since the guide surfaces extend from the rear upper edge portion of the first column portion and the front upper edge portion of the second column portion to the engaging portions, right under the inner side of the support wall, the stepped portions formed at both ends of the tab holder or the engaged portions formed at the tab holder can be guided in three directions, between the inner sides of the support walls and to the guide surface. Further, since it is possible to fit the protrusions formed on the inner side of the tab holder into the recessions formed on the guide surfaces, it is possible to prevent the protrusions of the tab holder from interfering with the guide surfaces in contact with each other.

Further, since a plane portion is not configured on the guide surfaces, like the invention described in Patent Document 1, when pressing force is applied to the tab holder from above after the engaged portions of the tab holder come in contact with the guide surfaces, the engaged portions can slide along the guide surfaces without stopping on the guide surfaces. In addition, it is possible to surely fit the engaged portion to the engaging portions formed at the first column portion and the second column portion.

As described above, in the invention, the engaged portions of the tab holder can slide toward the engaging portion smoothly along the guide surfaces even in assembling with an automatic assembly machine. Therefore, it is possible to surely prevent that the engaged portions of the tab holder stop sliding and the tbp holder is broken by pressing force from above.

In the invention, the shapes of the upper surfaces of the protrusions formed on the inner side of the tab holder may be formed as inclined surfaces that are inclined upward at an angle toward the center portion in the longitudinal direction of the tab holder from the edge portion adjacent to the protrusion and the inner side of the tab holder at the side of the end of the tab holder. Therefore, when the portion between both ends of the tab holder is opened and enlarged in order to engage and attach the tab holder between the pair of column portions, it is possible to avoid stress concentration on the edge portion adjacent to the protrusion and the inner side of the tab holder. Further, when the tab holder is engaged and attached between the pair of column portions, it is possible to perform smooth opening/closing between both ends of the tab holder.

Further, in the wall portion formed between the inner sides of the recessions formed on the inclined surfaces and the rear side of the first column portion or the front side of the second column portion, even when open grooves that communicate with the recessions formed on the inclined surfaces are formed, it is possible to configure the wall portion as a wall portion having a desired thickness. In addition, even if barrel polishing is performed on the slider body, it is possible to prevent the edges of the open grooves from being damaged or bleached.

Further, it is possible to integrally configure the protruding pieces fitted in the open grooves with the protrusions fitted in the recessions. In addition, as the protruding pieces are fitted in the open grooves, it is possible to prevent slipping in the front-rear and left-right directions between the tab holder and the slider bode even with the protruding pieces and the open grooves.

The configuration related to the protruding pieces and the protrusions is formed in a T-shape when seen from above, so that it is possible to configure the fitting state between the protruding pieces and the protrusions, and the open grooves and the recessions, with good left-right balance. By this configuration, it is possible to mount the tab holder that is a tab holder to the slider body, with good left-right balance and firmly. Further, even if torsion force is applied to the tab holder from the tab, it is possible to prevent the tab holder from being separated from the slider body.

MODE FOR CARRYING OUT THE INVENTION

Appropriate embodiments of the invention will be described hereafter in detail on the basis of the accompanying drawings. Sliders for a slide fastener of the invention may employ shapes and configurations if the shapes and configurations can solve the problems of the invention other than the shapes and configurations that will be described hereafter. For example, as a mounting configuration of a tab holder of a slider for a slide fastener having an automatic stop function, the configuration of the invention may be applied. Therefore, the invention is not limited to the embodiments described below and may be changed in various ways.

Embodiment 1

Figure 1:
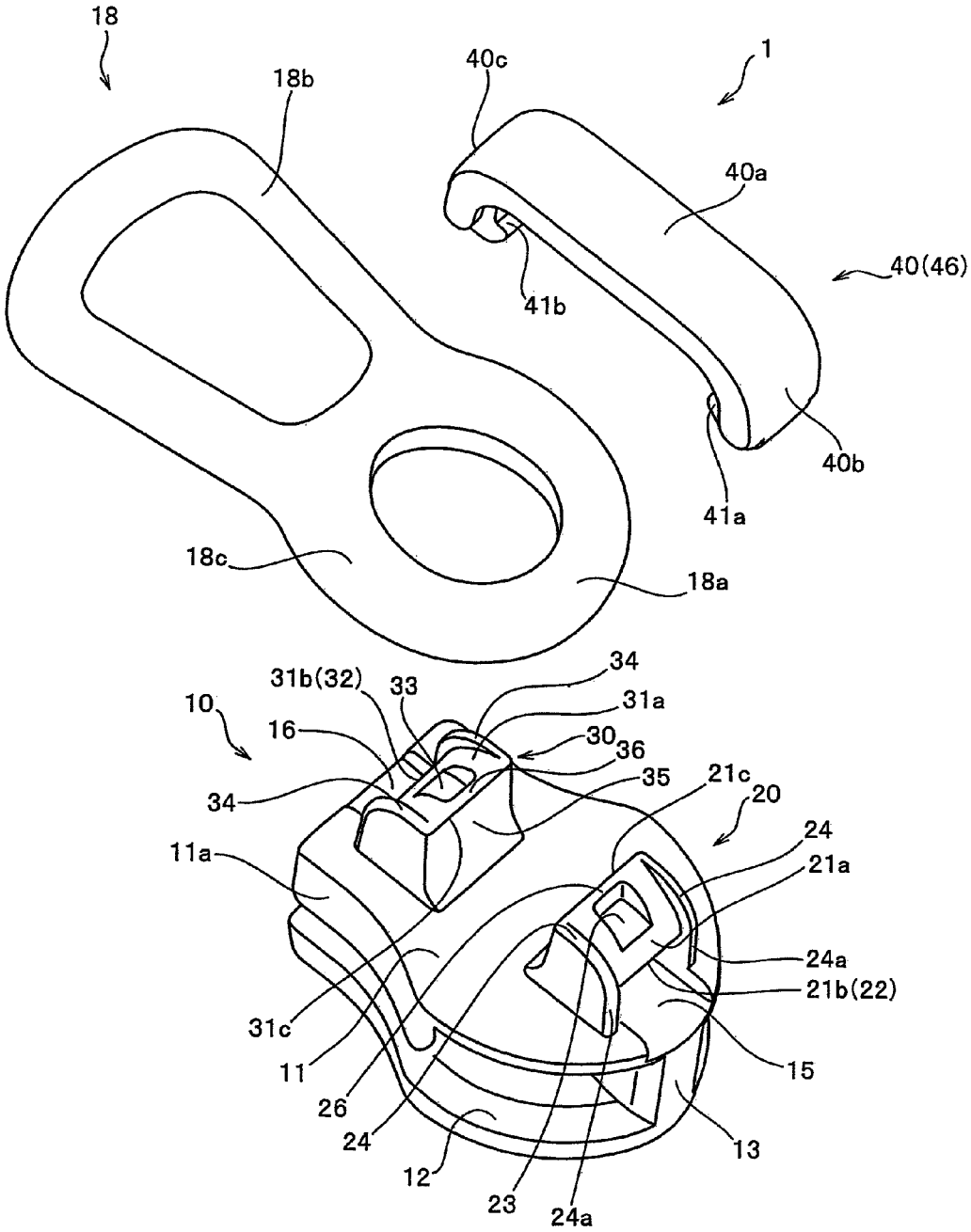
FIG. 1 is a perspective view illustrating the state before assembling the parts constituting a slider for a slide fastener (Embodiment 1).

A typical exemplary structure of a slider 1 for a slide fastener according to Embodiment 1 of the invention is illustrated in FIGS. 1 to 7. As illustrated in FIG. 1, the slider is composed of three members of a slider body 10, a tab 18, and a tab holder 40. The three members of the slider body 10, the tab 18, and the tab holder 40 are made of a resin material such as thermoplastic resin such as polyamide, polypropylene, polyacetal, and polybutylene terephthalate, or a thermoplastic resin material where an abrasion resistance reinforcement is added. Further, the members may be manufactured by forming means such as injection molding. In addition, the tab 18 may be manufactured by forming means such as die cast forming, using a metal material such as an aluminum alloy or a zinc alloy, instead of a resin material.

The slider body 10, as illustrated in FIGS. 1, and 3 to 5, has an upper blade 11, a lower blade 12, and a connecting post 13 connecting the front portion of the upper blade 11 with the front portion of the lower blade 12. A flange 11*a* is formed at the edges of both ends from the rear end to substantially the center position, on the lower surface of the upper blade 11. Further, a gap is formed between the lower end of the flange 11*a* installed on the upper blade 11 and the lower blade 12 and a Y-shaped engagement element guide passage is configured between the upper blade 11 and the lower blade 12.

Further, the example illustrated in the figures illustrates a configuration in which a flange is not installed at the lower blade 12 corresponding to the flange 11*a* installed at the upper blade 11, but the flange may be configured to be formed at the lower blade 12, as described in Patent Document 1 described above.

A first column portion 20 and a second column portion 30 where a tab holder 40 as a cover body 46 having a C-shape with long and thin sides is mounted are installed at the front and rear portions on the upper surface of the upper blade 11. The first column portion 20 and the second column portion 30 are formed to be integrally installed with the upper surface of the upper blade 11. A predetermined gap is provided between the first column portion 20 and the second column portion 30 and a space formed by the tab holder 40 mounted on the first column portion 20 and the second column portion 30 and the upper blade 11, the first column portion 20, and the second column portion 30 is formed as a space that receives a pintle 18*a* of the tab 18 and is enough to allow movement and rotation of the tab 18.

A recession 15 extending from the front base end of the first column portion 20 to the front end of the upper blade 11 is formed on the upper surface of the upper blade 11 at the front side of the first column portion 20. Further, a recession 16 extending from the rear base end of the second column portion 30 to the rear end of the upper blade 11 is formed on the upper surface of the upper blade 11 at the rear side of the second column portion 30.

The recessions 15 and 16 may make it possible not to set the heights of the first column portion 20 and the second column portion 30 to be unnecessarily large, to enlarge the gap formed between engaging portions 22 and 32 formed at the first column portion 20 and the second column portion 30 and the upper surface of the upper blade 11, and to easily engage engaged portions 41*a* and 41*b* of the tab holder 40. Further, the recessions 15 and 16 formed on the upper surface of the upper blade 11 function as a "relief" that prevents the engaged portions 41*a* and 41*b* formed at the tab holder 40 from coming in contact with the upper surface of the upper blade 11, when the tab holder 40 is engaged and attached to the first column portion 20 and the second column portion 30.

Figure 3:
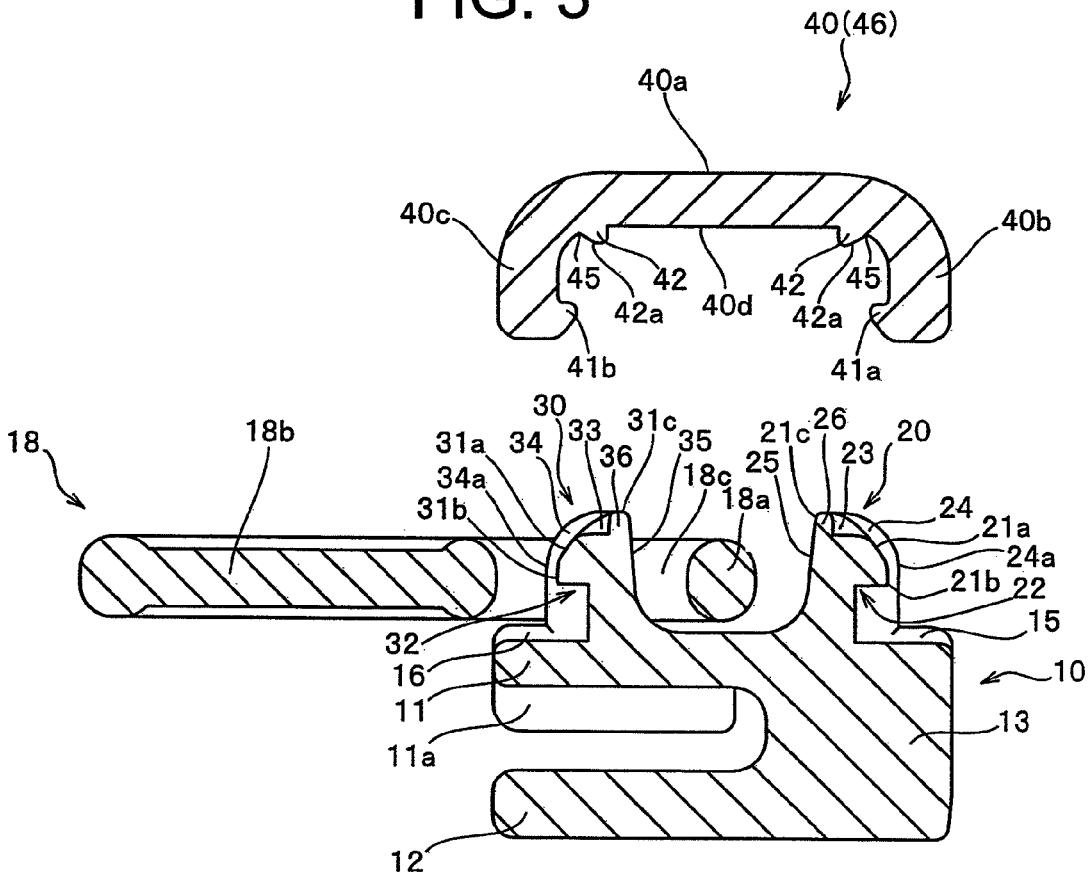
FIG. 3 is a longitudinal cross-sectional view illustrating a tab holder, a tab, and a slider body (Embodiment 1).

Further, as illustrated in FIG. 3, the facing surfaces of the first column portion 20 and the second column portion 30 are configured by inclined surfaces to be widened upward and narrowed downward, and the facing surfaces of the first column portion 20 and the second column portion 30 may be vertically formed in parallel. In addition, the portion between the lower ends of the first column portion 20 and the second column portion 30 and the upper surface of the upper blade 11 is configured to be connected in a smooth curved surface. By this configuration, it is possible to improve attachment strength of the first column portion 20 and the second column portion 30 installed from the upper surface of the upper blade 11.

The first column portion 20 and the second column portion 30 according to the example illustrated in the drawings are installed to be spaced, with the rear sides facing each other, at the front and rear portions of the upper surface of the upper blade 11. Further, the first column portion 20 and the second column portion 30 have the same structure except for the direction when they are installed on the upper surface of the upper blade 11. Therefore, in the following description, the configuration of the first column portion 20 is mainly described in detail. In addition, the description of the configuration of the second column portion 30 is not provided except for a necessary case. Instead, for the reference numbers of the members constituting the second column portion 30, reference numerals added with "10" to the reference numerals of the members constituting the first column portion 20 are used.

As illustrated in FIGS. 1 and 3, an inclined surface 21*a* that is inclined downward toward the front side of the upper blade 11 from an upper edge portion 21*c* of the rear side of the first column portion 20 is formed at the center portion in the left-right width direction of the first column portion 20. An inclined surface 31*a* formed at the second column portion 30 is formed at the center portion in the left-right width direction of the second column portion 30 and formed as the inclined surface 31*a* that is inclined downward toward the rear side of the upper blade 11 from an upper edge portion 31*c* of the front side of the second column portion 30.

The side cross-sections of the inclined surfaces 21*a* and 31*a* may be formed in curved shapes having downward smooth convex curved surfaces. By this configuration, it is possible to make the volumes of the first column portion 20 and the second column portion 30 large and increase strength of the first column portion 20 and the second column portion 30.

Further, the side shapes in the longitudinal direction of a pair of support walls 24, 24, 34, and 34 installed at both the left and right ends of the inclined surfaces 21*a* and 31*a*, which are described below, are configured in curved surfaces having downward smooth convex surface, and the height between the upper surfaces of the inclined surfaces 21*a* and 31*a* and the end upper surfaces of the pair of support walls 24, 24, 34, and 34 may be configured to be short. In addition, it is possible to improve attachment strength of the pair of support walls 24, 24, 34, and 34.

Furthermore, the inclined surfaces 21*a* and 31*a* may be configured as plane-shaped inclined surfaces that are inclined downward, if necessary.

The pair of support walls 24 and 24 are formed along both the left and right edge portions, at both the left and right edge portions of the inclined surface 21*a* of the first column portion 20. Further, the upper surfaces of the support walls 24 and 24 are configured to be connected to the upper edge portion 21*c* of the rear side of the first column portion 20 and to extend from the upper edge portion 21*c* of the rear side to be installed. In addition, the support walls 24 and 24 are formed to be bent downward from the middle portion and the lower ends of the support walls 24 and 24 are integrally formed with the upper blade 11.

The upper surfaces of the pair of support walls 34 and 34 formed at both the left and right edge portions of the inclined surface 31*a* of the second column portion 30 are configured to be connected to the upper edge portion 31*c* at the front side of the second column portion 30, and to extend from the upper edge portion 31*c* at the front side to be installed.

A front edge portion 21*b* of the inclined surface 21*a* of the first column portion 20 is disposed inside further than front ends 24*a* of the support walls 24 and 24. Further, the engaging portion 22 that engages the engaged portion 41*a* of the tab holder 40 is formed on the rear side of the inclined surface 21*a*. In addition, the recession 15 formed on the front side of the upper blade 11 is installed to extend to the lower surface side of the engaging portion 22 in order to make the space at the lower surface of the engaging portion 22 wide.

A front edge portion 31*b* of the inclined surface 31*a* of the second column portion 30 is disposed inside further than rear ends 34*a* of the support walls 34 and 34. Further, the engaging portion 32 that engages the engaged portion 41*b* of the tab holder 40 is formed on the rear side of the inclined surface 31*a*. In addition, the recession 16 formed on the rear side of the upper blade 11 is installed to extend to the lower surface side of the engaging portion 22 in order to make the space at the lower surface side of the engaging portion 32 wide. The transverse widths of the recession 15 and the recession 16 are configured as the gaps between the inner sides of the support walls 24, 24, 34, and 34.

A recession 23 is formed on the inclined surface 21*a* of the first column portion 20. As illustrated in FIGS. 1 and 3, as the shape of the recession 23, a configuration with one side open is illustrated, but the recession 23 may be configured in a recessed shape with four sides. The recession 23 may be formed at a predetermined portion on the inclined surface 21*a*, as long as the inclined surface 21*a* can be installed at both left and right sides and the rear side of the recession 23. However, it is preferable to form the recession 23 at the center portion in the left-right width direction of the inclined surface 21*a* in order to keep the engaging and attaching state of a protrusion 42 of the tab holder 40 (described below) and the recession 23 good.

A wall portion 26 is configured between the rear side of the recession 23 and a rear side 25 of the first column portion 20. Further, a wall portion 36 is configured between the front side of a recession 33 and a front side 35 of the second column portion 30. As the wall portion 26, a wall portion having a desired thickness may be configured. In addition, since the upper surface of the wall portion 26 is configured as a portion of the inclined surface 21*a*, the upper surface of the wall portion 26 configured as a portion of the inclined surface 21*a* may function as a guide surface, when the protrusion 42 of the tab holder 40 is fitted to the recession 23 (described above).

The tab 18 is configured to have the pintle 18*a* received in the space formed by the tab holder 40, the upper blade 11, the first column portion 20, and the second column portion 30, a ring-shaped portion 18*c* constituting the pintle 18*a*, and a grip portion 18*b*. An example in which the pintle 18*a* is formed in an arc shape which is a portion of the ring-shaped portion 18*c* is illustrated. However, the tab shape of the invention is not limited to the tab shape described above and well-known shapes may be used as long as the shapes allow the tab 18 to be received in the space formed by the tab holder 40, the upper blade 11, the first column portion 20, and the second column portion 30 and allow the tab to move and rotate in the space.

Figure 2:
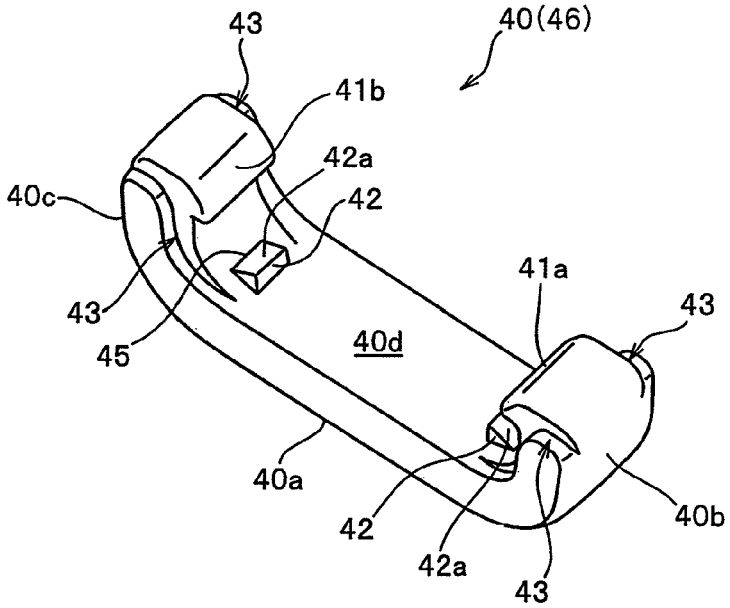
FIG. 2 is a perspective view of a tab holder seen from the inside (Embodiment 1).

As illustrated in FIGS. 1 and 2, the tab holder 40 is configured as the C-shaped cover body 46 with the long and thin side and the cover body 46 is configured to have a long upper wall portion 40*a* and a front wall portion 40*b* and a rear wall portion 40*c* extending downward at both ends of the upper wall portion 40*a*. An engaged portion 41*a* elastically engaging with the engaging portion 22 formed at the first column portion 20 is formed on the inner side of the front wall portion 40*b*, and an engaged portion 41*b* elastically engaging with the engaging portion 32 formed at the second column portion 30 is formed on the inner side of the rear wall portion 40*c*.

As illustrated in FIG. 2, a pair of protrusions 42 and 42 spaced in the front-rear direction are formed on an inner side 40*d* of the tab holder 40. Further, stepped portions 43, 43, 43, and 43 are formed along the edge portions of both sides, at both ends of the front wall portion 40*b* and the rear wall portion 40*c*.

Figure 4:
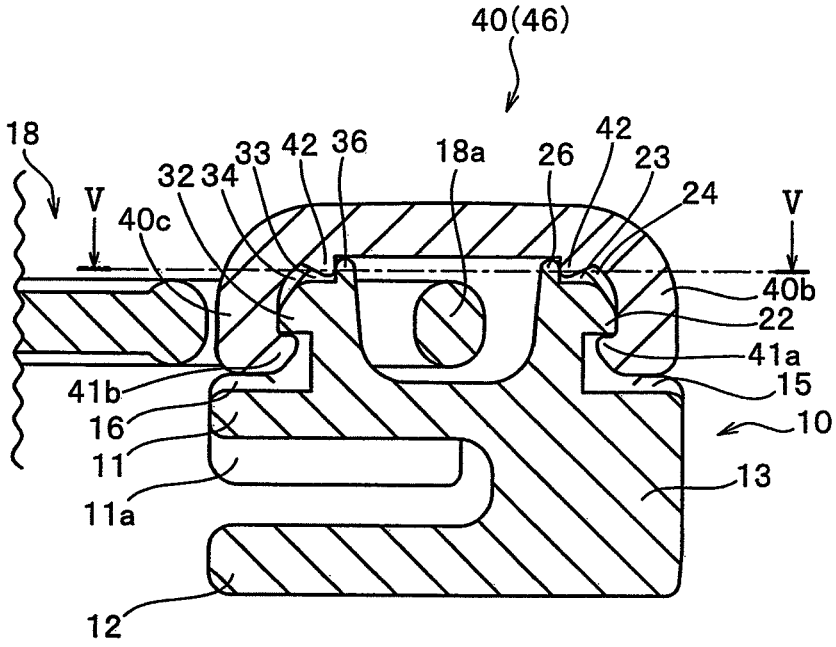
FIG. 4 is a longitudinal cross-sectional view illustrating the state when the tab holder is engaged and attached to the slider body (Embodiment 1).

As illustrated in FIG. 4, the pair of protrusions 42 and 42 may be fitted into the recessions 23 and 33 formed at the first column portion 20 and the second column portion 30, when the tab holder 40 is engaged and attached between the first column portion 20 and the second column portion 30. Further, the stepped portions 43, 43, 43, and 43 may be in contact with the inner sides and the end surfaces of the support walls 24, 24, 34, and 34 formed at the first column portion 20 and the second column portion 30.

Further, even if the tab holder 40, the first column portion 20, and the second column portion 30 are loosely engaged and attached, as the pair of protrusions 42 and 42 are fitted in the recessions 23 and 33, the tab holder 40 can be prevented from slipping in the front-rear and left-right directions with respect to the slider body 10.

Figure 5:
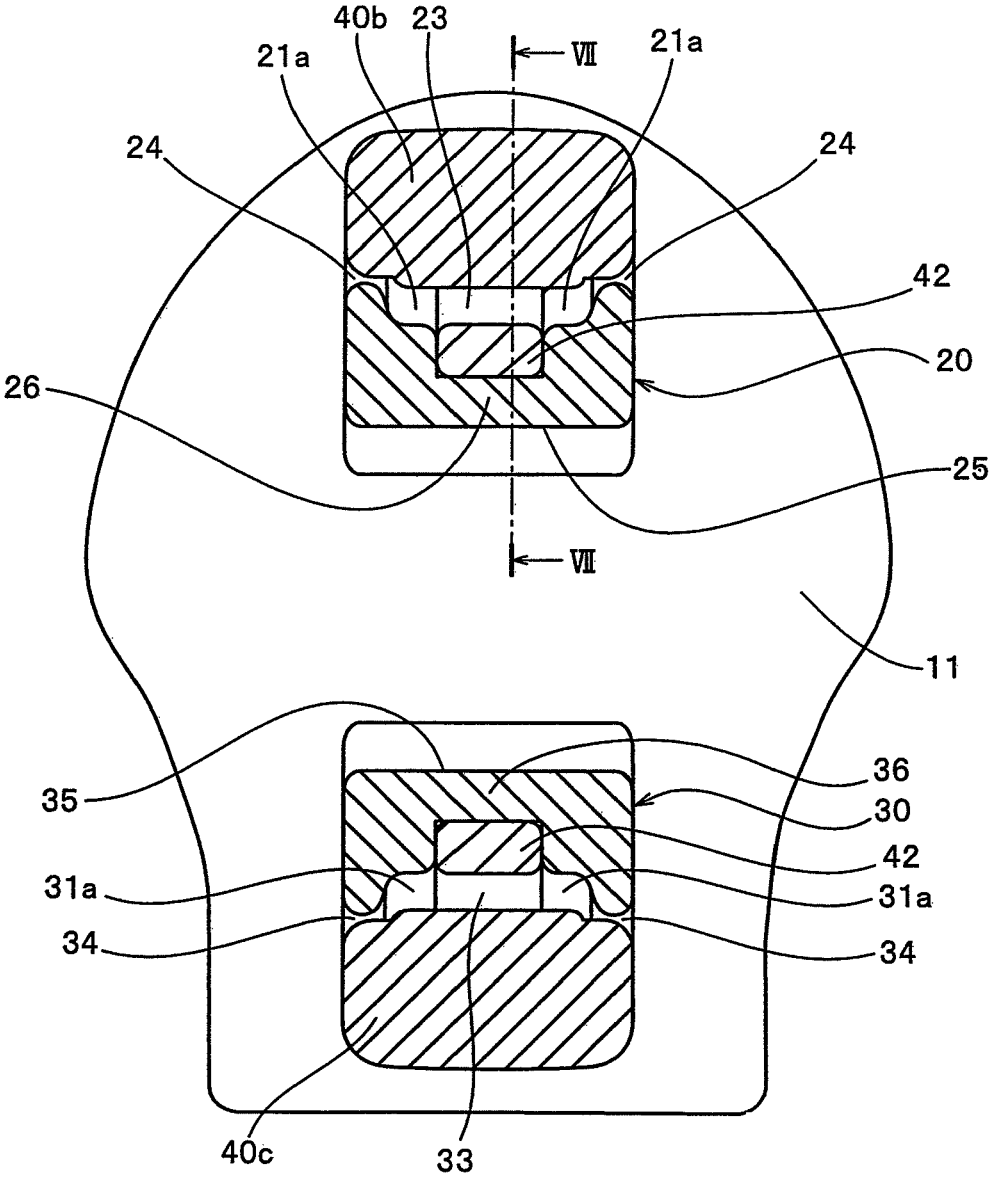
FIG. 5 is a view enlarging a cross-section seen in the direction of an arrow of line V-V of FIG. 4 (Embodiment 1).
Figure 6:
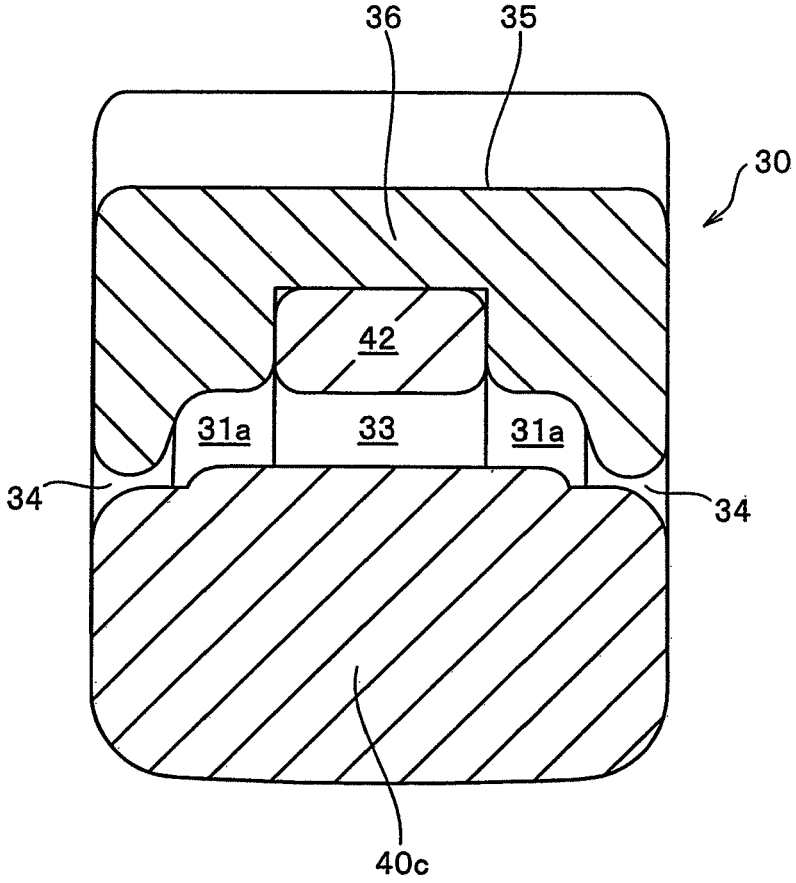
FIG. 6 is an enlarged view of the main parts of FIG. 5 (Embodiment 1).

That is, as illustrated in FIG. 5 that is a cross-sectional view taken along line V-V of FIG. 4 and FIG. 6 that is an enlarged view of the main parts of FIG. 5, by contact of the pair of protrusions 42 and 42 and the sides of the recessions 23 and 33, the tab holder 40 can be prevented from slipping in the front-rear and left-right directions.

Further, as the stepped portions 43, 43, 43, and 43 are in contact with the inner sides and the end surfaces of the support walls 24, 24, 34, and 34, the tab holder 40 can be prevented from slipping in the front-rear and left-right directions with respect to the slider body 10.

As illustrated in FIG. 2, the upper surfaces of the pair of protrusions 42 and 42 formed on the inner side 40*d* of the tab holder 40 are formed as inclined surfaces 42*a* that are inclined upward at an angle from an edge portion 45 adjacent to the inner side 40*d* of the tab holder 40 to the center portion of the tab holder 40. As the upper surfaces of the pair of protrusions 42 and 42 are configured as the inclined surfaces, the inclined surface 42*a* may be configured not to cross the inner side of the tab holder 40 at an acute angle at the adjacent edge portion 45.

By this configuration, it is possible to avoid concentration of stress at the adjacent edge portion 45 even if the portion between both ends of the tab holder 40 is increased and opened, when the tab holder 40 is engaged and attached to the first column portion 20 and the second column portion 30. A smooth continuous concave surface may be configured from the inner side 40*d* of the tab holder 40 to the upper surfaces of the protrusions 42 and 42 in order to efficiently avoid stress concentration on the adjacent edge portion 45.

The configuration of the tab holder 40 is not a configuration specifically using the front-rear direction, and the engaged portion 41*a* of the front wall portion 40*b* may be engaged with the engaging portion 32 of the second column portion 30 and the engaged portion 41*b* of the rear wall portion 40*c* may be engaged with the engaging portion 22 of the first column portion 20. By this configuration, the tab holder 40 may be engaged and attached to the first column portion 20 and the second column portion 30 without considering the front-rear direction of the tab holder 40.

Next, assembly of the slider 1 is described. As illustrated in FIG. 3, as the pintle of the tab 18 is inserted between the first column portion 20 and the second column portion 30 and the tab holder 40 disposed in parallel with the upper blade 11 is covered from above the slider body 10, the engaged portions 41*a* and 41*b* of the tab holder 40 can increase and open the gap between the engaged portions 41*a* and 41*b* while sliding on the inclined surfaces 21*a* and 31*a* formed at the first column portion 20 and the second column portion 30. Therefore, the left-right transverse widths of the engaged portions 41*a* and 41*b* are configured to be larger than the left-right transverse widths of the recessions 23 and 33 formed on the inclined surfaces 21*a* and 31*a*.

Figure 7:
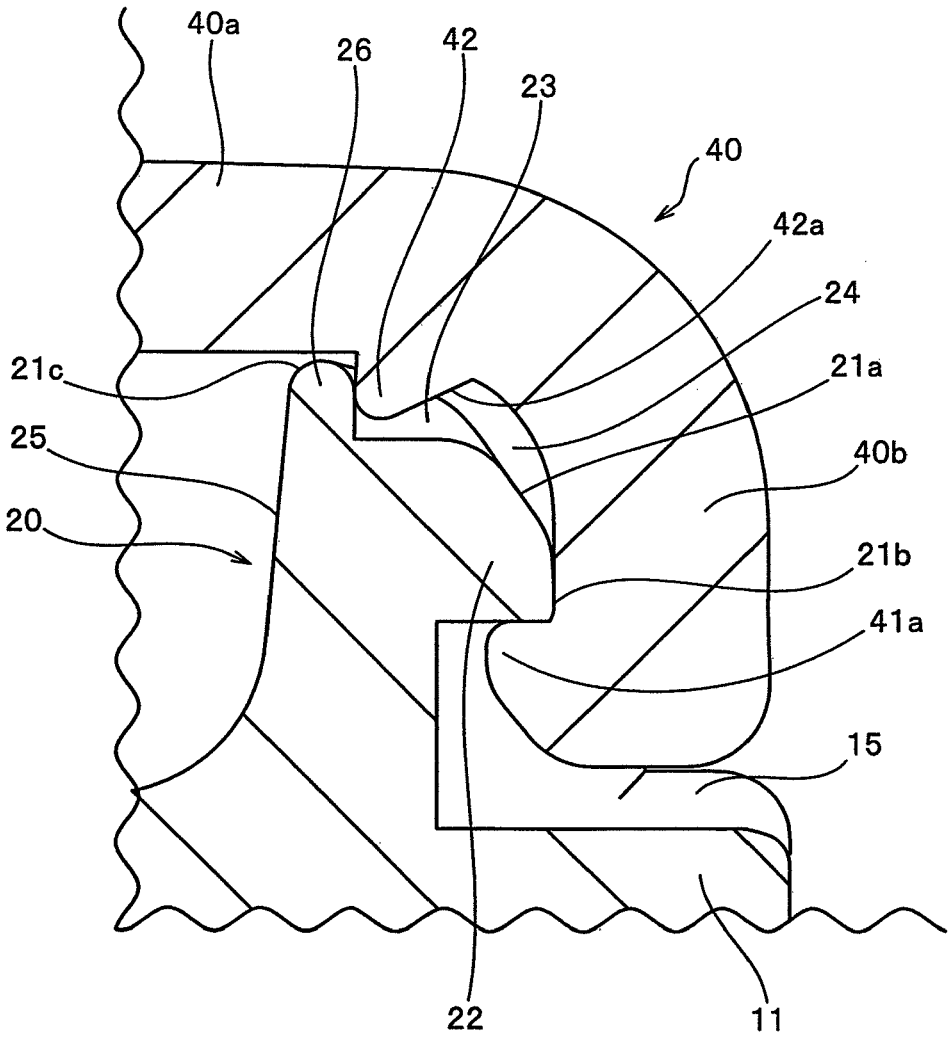
FIG. 7 is a view enlarging a cross-section seen in the direction of an arrow of line VII-VII of FIG. 5 (Embodiment 1).

The tab holder 40 that elastically deforms and increases and opens the gap between the engaged portions 41*a* and 41*b* by sliding on the inclined surfaces 21*a* and 31*a*, as illustrated in FIG. 7, becomes narrowed by elastic force, when the engaged portions 41*a* and 41*b* go beyond the front edge portions 21*b* and 31*b* of the inclined surfaces 21*a* and 31*a*. Further, the engaged portions 41*a* and 41*b* may be engaged with the engaging portions 22 and 32 formed at the first column portion 20 and the second column portion 30. In addition, when the engaged portion 41*a* and 41*b* slide on the inclined surfaces 21*a* and 31*a*, the inner sides of each of the pairs of support walls 24, 24, 34, and 34 function as guide surfaces that prevent the engaged portions 41*a* and 41*b* from being separated in the left-right direction.

When the engaged portions 41*a* and 41*b* are engaged with the engaging portions 22 and 32, the recession 15 formed on the front side of the upper blade 11 and the recession 16 formed on the rear side of the upper blade 11 may show the function of a "relief" that prevents the engaged portions 41*a* and 41*b* from coming in contact with the upper surface of the upper blade 11. As described above, it is possible to make the snap-engagement of the engaged portions 41*a* and 41*b* with the engaging portions 22 and 32 smooth and accurate.

Further, when the engaged portions 41*a* and 41*b* slide on the inclined surfaces 21*a* and 31*a*, the pair of protrusions 42 and 42 formed on the inner side 40*d* of the tab holder 40 slide on the upper surface of the wall portion 26 of the first column portion 20 and the upper surface of the wall portion 36 of the second column portion 30, such that they can be smoothly and accurately fitted into the recessions 23 and 33 formed on the inclined surfaces 21*a* and 31*a*. Since the inclined surfaces 42*a* and 42*a* formed on the upper surfaces of the protrusions 42 and 42 and the inclined surfaces 21*a* and 31*a* constituting the upper surfaces of the wall portions 26 and 36 are in partial sliding contact with each other, the protrusions 42 and 42 can be smoothly fitted into the recessions 23 and 33.

As the engaged portions 41*a* and 41*b* are engaged with the engaging portions 22 and 32, the pair of stepped portions 43 formed at the front wall portion 40*b* and the rear wall portion 40*c* of the tab holder 40 are in contact with the inner sides and the end surfaces of the pair of support walls 24 and 34 formed at the first column portion 20 and the second column portion 30. Accordingly, it is possible to remove the gap between the tab holder 40 and the pair of support walls 24 and 34, and coat, fit, and attach the portion between the first column portion 20 and the second column portion 30 with the tab holder 40.

As the assembly method of engaging and attaching the tab holder 40 to the first column portion 20 and the second column portion 30, an assembly method of covering the tab holder 40 from above the first column portion 20 and the second column portion 30 was described, but it may be possible to use an assembly method of locking one of the engaged portions 41*a* and 41*b* of the tab holder 40 to the engaging portion 22 of the first column portion 20 or the engaging portion 32 of the second column portion 30, and rotating, fitting, and attaching the tab holder 40 such that the other of the engaged portions 41*b* and 41*a* of the tab holder 40 is engaged with the engaging portion 32 of the second column portion 30 or the engaging portion 22 of the first column portion 20.

By using this assembly method, it is possible to achieve a long distance from the engaging portion 32 of the second column portion 30 or the engaging portion 22 of the first column portion 20 that are the engaging portion with the other of the engaged portions 41*b* and the 41*a* that is engaged next, by the insertion of the claw of one of the engaged portions 41*a* and 41*b* in the engaging portion 22 or 32. Further, it is possible to reduce the amount of elastic deformation of the tab holder 40 and more smoothly and accurately rotate the tab holder 40.

As described above, since it is possible to surely engage and attach the tab holder 40 without slipping with respect to the first column portion 20 and the second column portion 30, even if large tensile load is applied to the tab holder 40 in the left-right direction or the inclination direction by movement or rotation of the tab 18, the tab holder 40 can be prevented from being separated from the first column portion 20 or the second column portion 30.

That is, it is possible to surely prevent the tab holder 40 from being separated in the front-rear and left-right directions without bending in the left-right direction or the inclination direction or up-down direction, in addition to the front-rear direction, against a pulling force in every direction by the operation of the tab 18.

Further, since a gap is not formed between the tab holder 40 and the slider body 10 by the stepped portion 43 formed at the tab holder 40, the engaging and attaching state of the pair of protrusions 42 and 42 and the recessions 23 and 33 is not seen from the outside with naked eyes, so that the slider 1 can be configured with excellent external appearance.

In addition, even when the tab holder 40 is engaged and attached to the first column portion 20 and the second column portion 30, the engaging and attaching operation can be smoothly and accurately performed.

Embodiment 2

Embodiment 2 of the invention is described with reference to FIGS. 8 to 11. In Embodiment 2, open grooves 27 and 37 are formed between the recession 23 and the rear side 25 of the first column portion 20 and between the recession 33 and the front side 35 of the second column portion 30 and protruding pieces 44 and 44 integrally formed with the pair of protrusions 42 and 42 are installed on the inner side 40*d* of the tab holder 40.

Further, when the tab holder 40 is engaged and attached to the first column portion 20 and the second column portion 30, the protruding pieces 44 and 44 are fitted in the open grooves 27 and 37, respectively.

The other configurations are the same as those of Embodiment 1. Therefore, the same reference numerals as those used in Embodiment 1 are used in Embodiment 2, and the members are not described.

Figure 8:
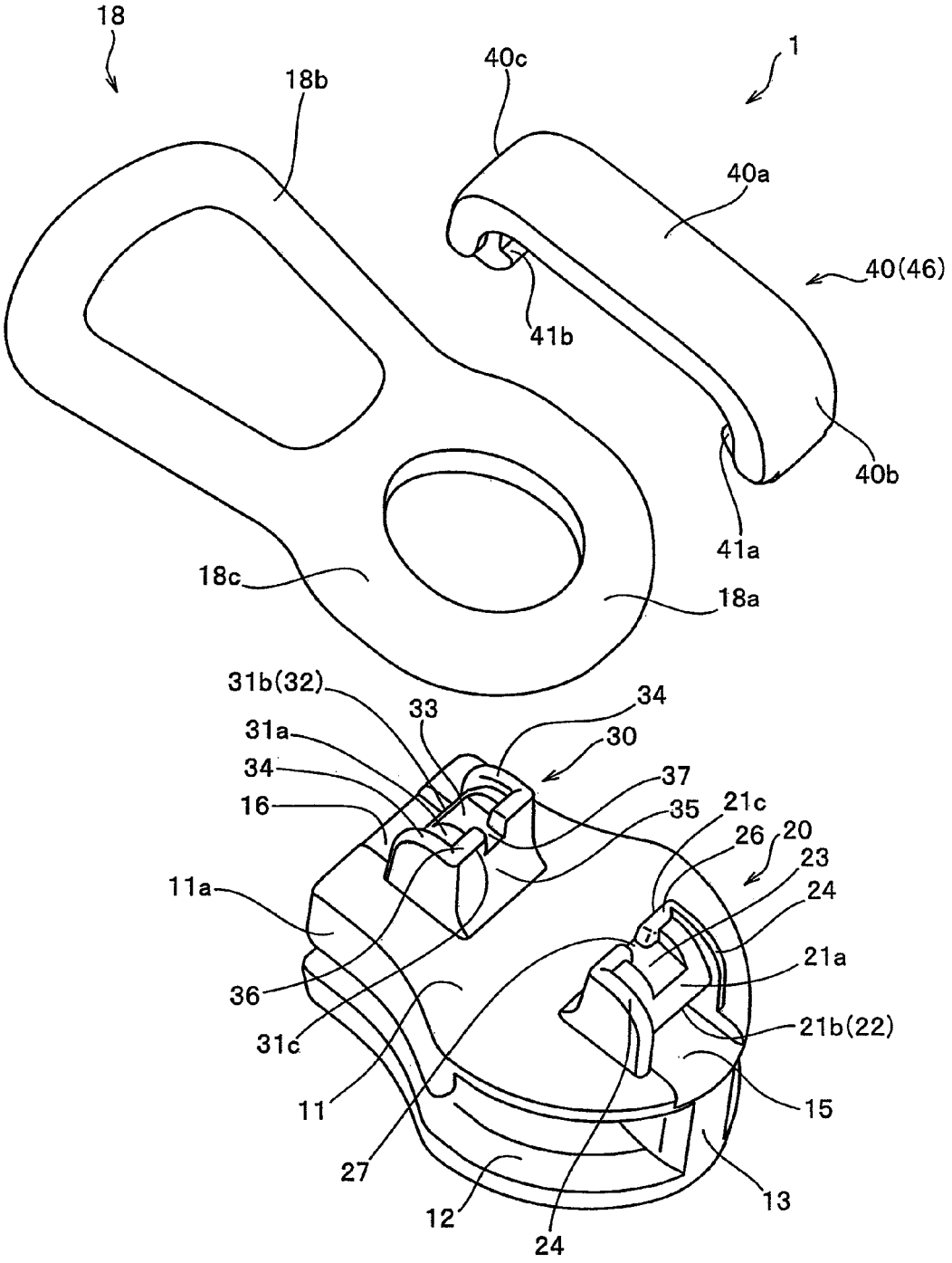
FIG. 8 is a perspective view illustrating the state before assembling the parts constituting a slider for a slide fastener (Embodiment 2).
Figure 9:
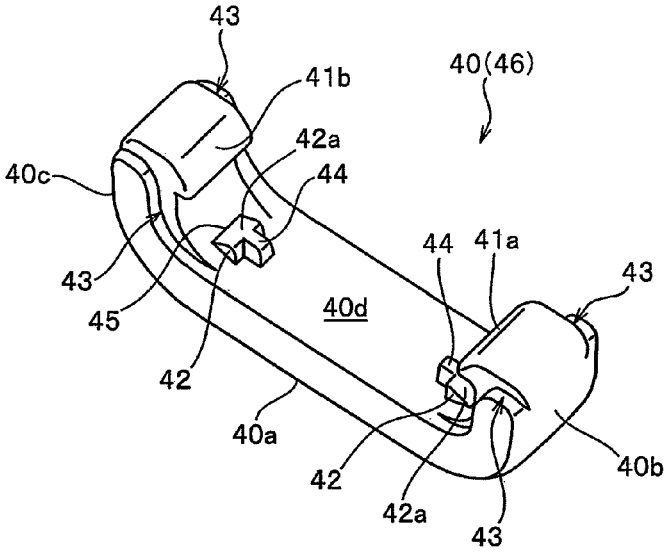
FIG. 9 is a perspective view of a tab holder seen from the inside (Embodiment 2).
Figure 10:
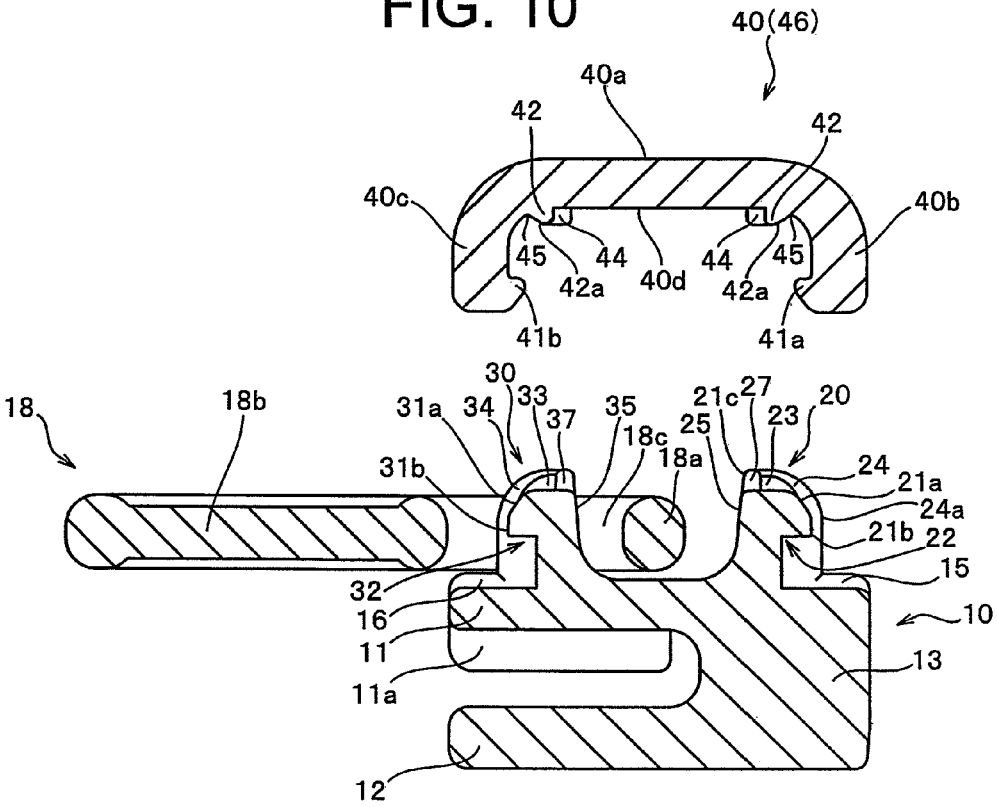
FIG. 10 is a longitudinal cross-sectional view illustrating a tab holder, a tab, and a slider body (Embodiment 2).
Figure 11:
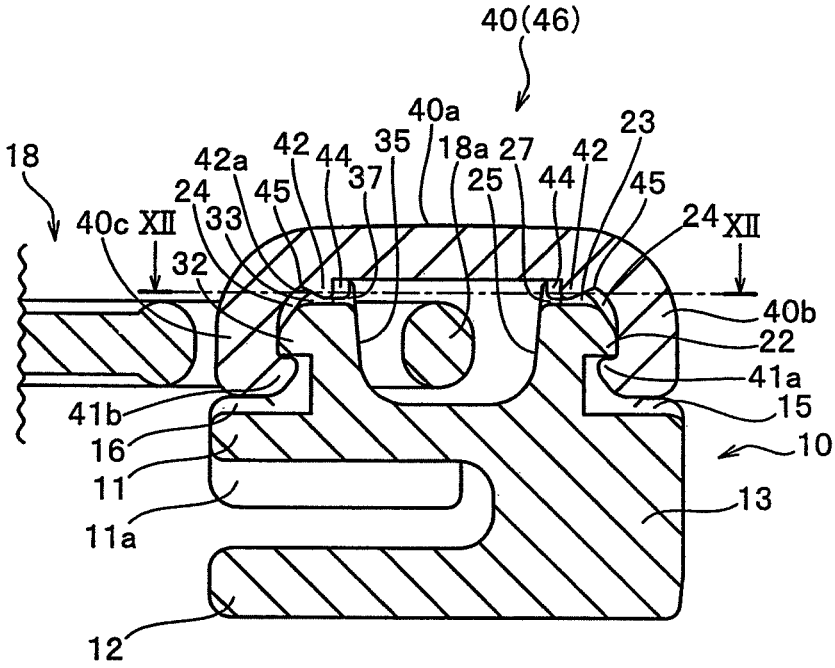
FIG. 11 is a longitudinal view illustrating the state when the tab holder is engaged and attached to the slider body (Embodiment 2).
Figure 12:
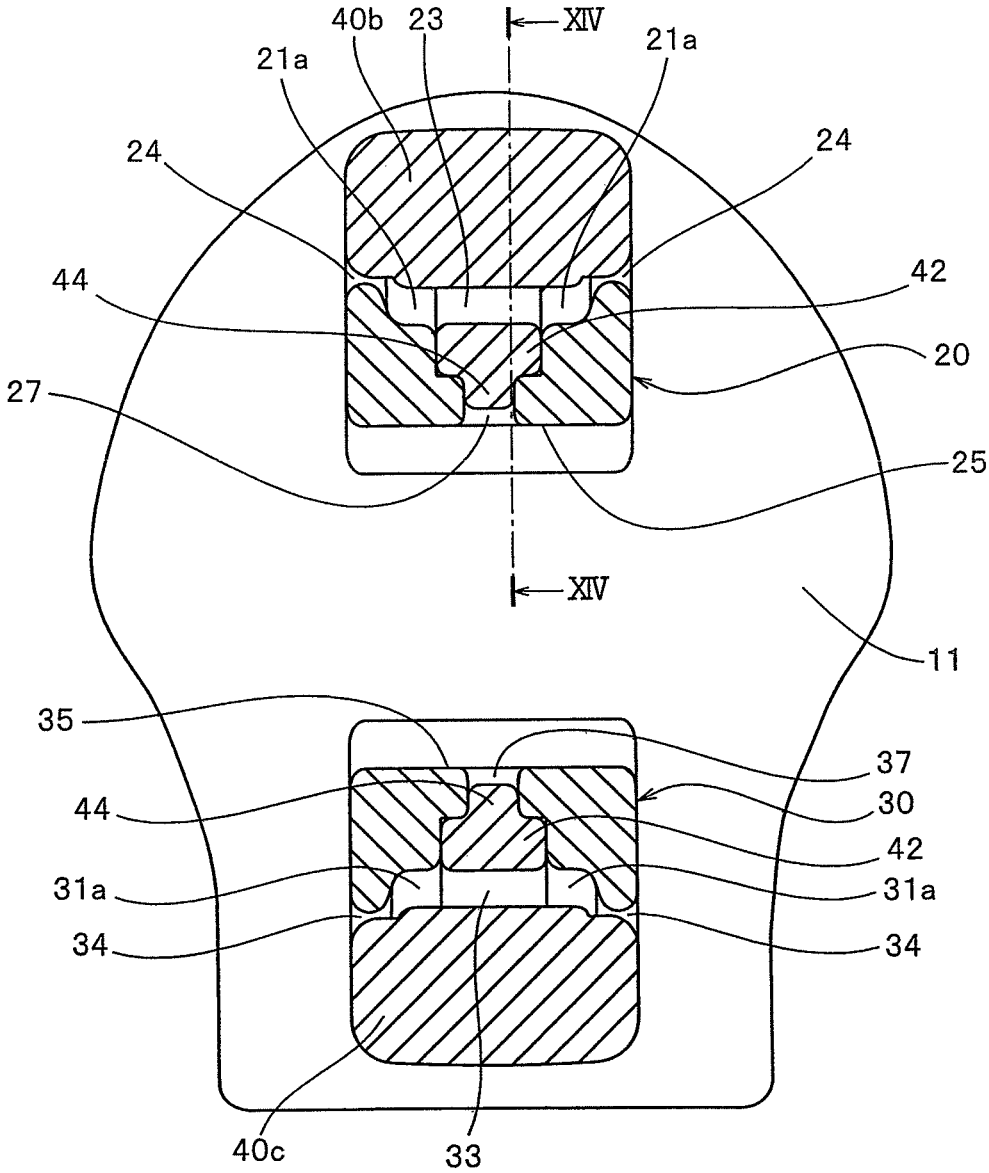
FIG. 12 is a view enlarging a cross-section seen in the direction of an arrow of line XII-XII of FIG. 11 (Embodiment 2).
Figure 13:
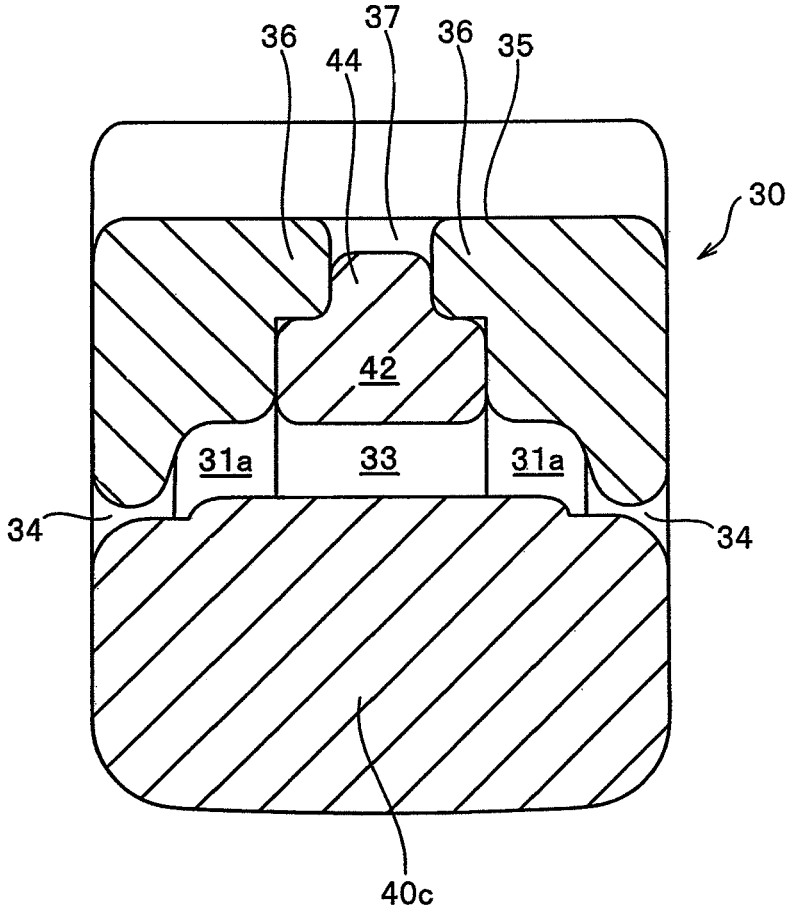
FIG. 13 is an enlarged view of the main parts of FIG. 12 (Embodiment 2).
Figure 14:
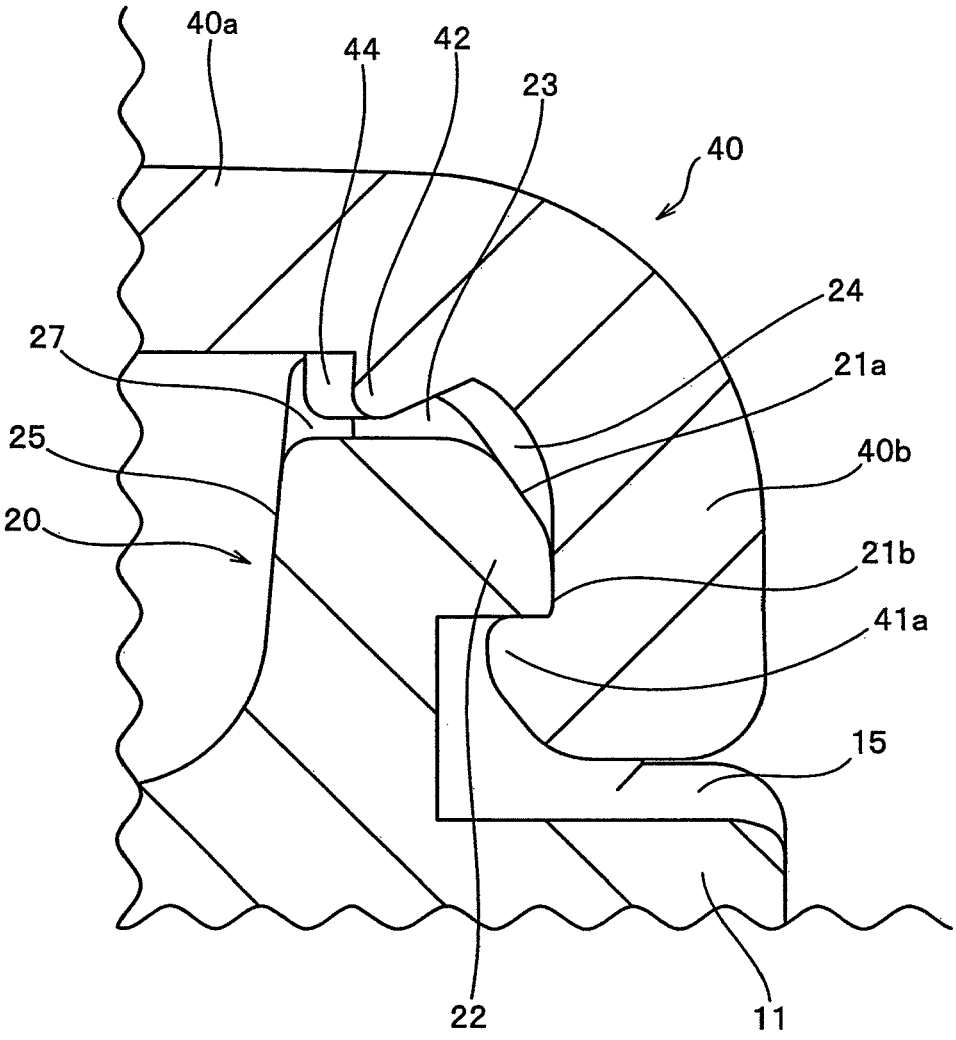
FIG. 14 is a view enlarging a cross-section seen in the direction of an arrow of line XIV-XIV of FIG. 12 (Embodiment 2).
Figure 15:
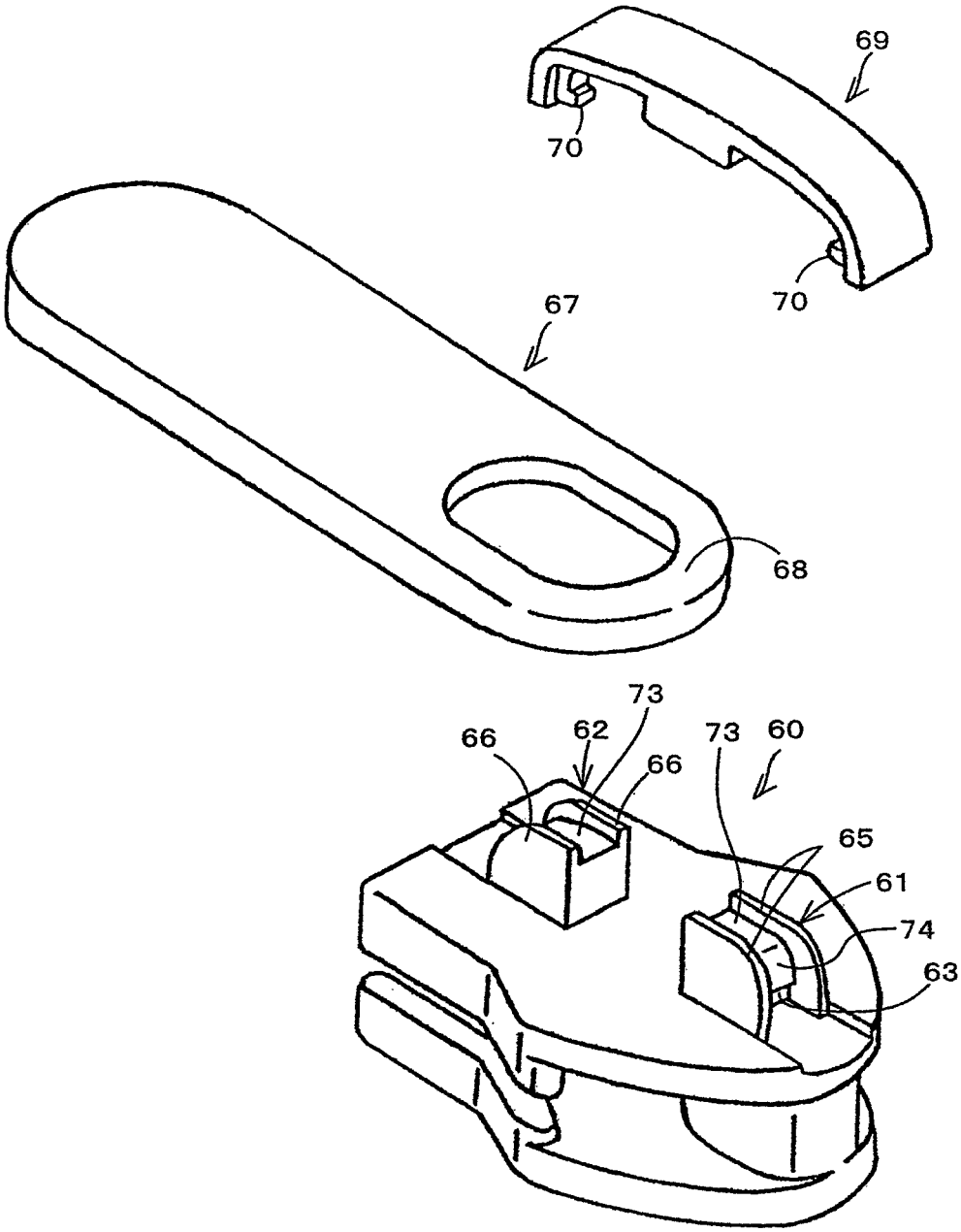
FIG. 15 is a perspective view illustrating the state before assembling the parts constituting a slider for a slide fastener (Related art).
Figure 16:
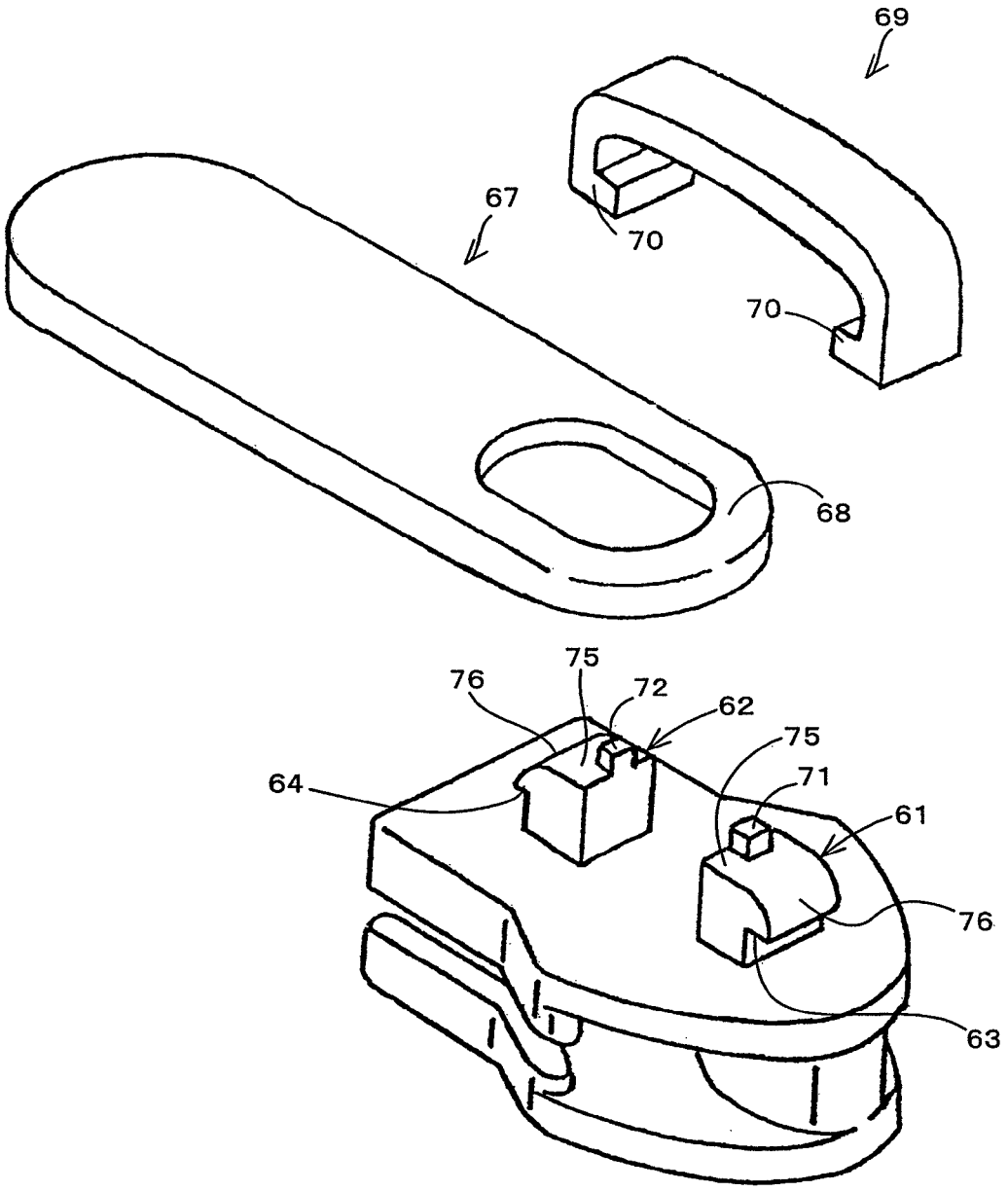
FIG. 16 is a perspective view illustrating the state before assembling the parts constituting another slider for a slide fastener (Related art).

As illustrated in FIGS. 8 and 10, the open grooves 27 and 37 formed by partially notching the wall portions 26 and 36 illustrated in Embodiment 1 are formed between the recession 23 and the rear side 25 of the first column potion 20 and between the recession 33 and the front side 35 of the second column portion 30. Further, as illustrated in FIGS. 9 and 10, the pair of protruding pieces 44 and 44 are formed to be connected to the protrusion 42 toward the side of the center portion of the tab holder 40 further than the protrusion 42, on the inner side 40*d* of the tab holder 40.

When the tab holder 40 is engaged and attached to the first column portion 20 and the second column portion 30, the pair of protruding pieces 44 and 44 can be fitted in the open grooves 27 and 37, respectively. Further, even when the tab holder 40 is engaged and attached to the first column portion 20 and the second column portion 30 from above or the tab holder 40 is engaged and attached by rotating, with one of the engaged portions 41*a* and 41*b* of the tab holder 40 engaged with the first column portion 20 or the second column portion 30, the pair of protruding pieces 44 and 44 can be fitted into the open grooves 27 and 37, respectively, from above or from above at an angle. Therefore, it is not necessary to form an inclined surface on the upper surfaces of the pair of protruding pieces 44 and 44 and it is possible to forma flat plane in parallel to the inner side of the upper wall portion 40*a* of the tab holder 40, as illustrated in FIG. 10.

In addition, as a surface extending the inclined surface 42*a* of the protrusion 42 formed on the inner side 40*d* of the tab holder 40, the upper surface of the protruding piece 44 may be formed.

When the tab holder 40 is engaged and attached to the first column portion 20 and the second column portion 30, the protruding pieces 44 and 44 can be engaged and attached to the open grooves 27 and 37, in addition to engaging and attaching the protrusion 42 of the tab holder 40 to the recession 23 formed at the first column portion 20 and engaging and attaching the protrusion 42 of the tab holder 40 to the recession 33 formed at the second column portion 30, so that it is possible to surely prevent the tab holder 40 from slipping in the front-rear and left-right directions.

Furthermore, since the protruding pieces 44 and 44 are in contact with the open grooves 27 and 37, in addition to the contact of the protrusions 42 and 42 and the recessions 23 and 33, it is possible to prevent the tab holder 40 from slipping in the left-right direction, so that the effect of preventing slipping can be greatly improved.

The connection shape of the protruding pieces 44 and 44 and the protrusions 42 and 42 may be configured in a T-shape when seen from above. As the shape is configured by a T-shape, even though torsion force or tensile force is applied to the tab holder 40 from the tab 18, it is possible to carry the force with the left-right balance kept good.

In the invention, even if barrel polishing is performed after the slider body 10 and the tab holder 40 are integrally formed by a resin material, it is possible to prevent the protrusion where a defect or bleaching is generated from individually protruding. Therefore, it is possible to improve productivity of the slider body 10 and the tab holder 40 and it is also possible to greatly increase the yield as a product. Further, it is possible to improve attachment strength of the tab holder 40 engaged and attached to the slider body 10 and to keep the external appearance as the slider 1 good.

INDUSTRIAL APPLICABILITY

The invention may be appropriately applied as a slider for a slide fastener.

DESCRIPTION OF REFERENCE NUMERALS

1 Slider for a slide fastener
10 Slider body
11 Upper blade
11*a* Flange
12 Lower blade

13 Connecting post
15, 16 Recession
18 Tab
18*a* Pintle
18*b* Grip portion
18*c* Ring-shaped portion
20 First column portion
21*a* Inclined surface
21*b* Front edge portion
21*c* Rear upper edge portion
22 Engaging portion
23 Recession
24 Support wall
24*a* Front end
25 Rear side
26 Wall
27 Open groove
30 Second column portion
31*a* Inclined surface
31*b* Front edge portion
31*c* Front upper edge portion
32 Engaging portion
33 Recession
34 Support wall
34*a* Rear end
35 Front side
36 Wall
37 Open groove
40 Tab holder
40*a* Upper wall
40*b* Front wall
40*c* Rear wall
40*d* Inner side
41*a*, 41*b* Engaged portion
42 Protrusion
42*a* Inclined surface
43 Stepped portion
44 Protruding piece
45 Adjacent edge portion
46 Cover body
60 Slider body
61, 62 Column portion
63, 64 Engaging portion
65, 66 Support wall
67 Tab
68 Pintle
69 Tab holder
70 Engaging portion
71, 72 Protrusion

The invention claimed is:

1. A slider for a slide fastener including:

a slider body having an upper blade and a lower blade that are spaced with a predetermined gap in an up-down direction and connected with each other at front portions with a connecting post therebetween;

a tab; and a tab holder that holds the tab between an upper surface of the upper blade and a lower side of the tab holder to be movable and rotatable, wherein at least the slider body and the tab holder are made of a resin material, a first column portion and a second column portion installed at front and rear portions on the upper surface of the upper blade are included, engaging portions are formed on a front side of the first column portion and a rear side of the second column portion, respectively, the tab holder is configured by a plate-shaped cover body having an upper wall portion, and a front wall portion and a rear wall portion extending downward in a longitudinal direction of the upper wall portion, an engaged portion that is elastically engaged and attached to the engaging portion of the first column portion is formed on a rear inner side of the front wall portion, an engaged portion that is elastically engaged and attached to the engaging portion of the second column portion is formed on a front inner side of the rear wall portion, in the first column portion, an inclined surface continuously extends downward from a rear side upper edge portion of the first column portion towards the front side of the first column portion and is formed at a center portion in a left-right width direction of the first column portion, support walls extend from the rear side upper edge portion of the first column portion along both left and right edge portions of the inclined surface of the first column portion, and a front edge portion on a front side of the inclined surface of the first column portion is disposed further inside than an end face of a front side of the support walls of the first column portion, in the second column portion, an inclined surface continuously extends downward from a front side upper edge portion of the second column portion towards the rear side of the second column portion and is formed at a center portion in the left-right width direction of the second column portion, support walls extend from the front side upper edge portion of the second column portion along both left and right edge portions of the inclined surface of the second column portion, and a front edge portion on a rear side of the inclined surface of the second column portion is disposed further inside than an end face of a rear side of the support walls of the second column portion, in the first column portion, a wall portion is disposed between a rear side of a recession of the first column portion and a rear side of the first column portion, wherein the wall portion is as high as the rear side of the upper edge portion of the first column portion, in the second column portion, a wall portion is disposed between a front side of a recession of the second column portion and a front side of the second column portion, wherein the wall portion is as high as the front side of the upper edge portion of the second column portion, the recessions are formed on the inclined surfaces of the first column portion and the second column portion, respectively, and for each of the first column portion and the second column portion, a right side edge of the inclined surface is between the recession and one of the support walls and a left side edge of the inclined surface is between the recession and another of the support walls, and when the tab holder is engaged and attached to the first column portion and the second column portion, protrusions fit in the recessions, the protrusions are formed on an inner side of the tab holder which faces the first column portion and the second column portion, respectively, and stepped portions at the front wall portion of the tab holder contact inner sides and end surfaces of the support walls of the first column portion and stepped portions at the rear wall portion of the tab holder contact inner sides and the end surfaces of the support walls of the second column portion.

2. The slider for a slide fastener of claim 1, wherein lower surfaces of the protrusions formed on the inner side of the tab holder are formed as inclined surfaces inclined upward downward at an angle toward a center portion of the tab holder and the protrusions are formed between the engaged portion formed on the rear inner side of the front wall portion and the engaged portion formed on the front inner side of the rear wall portion in the longitudinal direction of the tab holder.

3. The slider for a slide fastener of claim 1, wherein an open groove is formed in each of the wall portions, wherein the open groove in the first column portion connects with the recession of the first column portion and the open grove in the second column portion connects with the recession of the second column portion, protruding pieces that fit in the open grooves are formed on the inner side of the tab holder facing the open grooves, and the protruding pieces are integrally formed with the protrusions.

4. The slider for a slide fastener of claim 3, wherein each of the protrusions integrally formed with the protruding pieces and the protruding pieces are formed in a T-shape when seen from above.

* * * * *

UNITED STATES PATENT AND TRADEMARK OFFICE

CERTIFICATE OF CORRECTION

PATENT NO. : 9,003,614 B2
APPLICATION NO. : 13/638941
DATED : April 14, 2015
INVENTOR(S) : Takanori Ozawa et al.

It is certified that error appears in the above-identified patent and that said Letters Patent is hereby corrected as shown below:

In the Specification

In column 2, line 67, delete “portion” and insert -- portions --, therefor.

In column 6, line 27, delete “tbp” and insert -- tab --, therefor.

In column 6, line 59, delete “bode” and insert -- body, --, therefor.

In the Claims

In column 16, line 63, in claim 1, delete “the end” and insert -- end --, therefor.

In column 16, line 67, in claim 2, after “inclined” delete “upward”.

Signed and Sealed this
First Day of September, 2015

Michelle K. Lee

Michelle K. Lee
*Director of the United States Patent and Trademark Office*